US011154995B2

(12) United States Patent
Lau

(10) Patent No.: US 11,154,995 B2
(45) Date of Patent: Oct. 26, 2021

(54) FOLDING KNIFE

(71) Applicant: Neil Lau, Los Altos, CA (US)

(72) Inventor: Neil Lau, Los Altos, CA (US)

( * ) Notice: Subject to any disclaimer, the term of this patent is extended or adjusted under 35 U.S.C. 154(b) by 58 days.

(21) Appl. No.: 16/694,182

(22) Filed: Nov. 25, 2019

(65) Prior Publication Data

US 2021/0154868 A1 May 27, 2021

(51) Int. Cl.
*B26B 1/04* (2006.01)

(52) U.S. Cl.
CPC ..... *B26B 1/048* (2013.01)

(58) Field of Classification Search
CPC ..... B26B 1/04; B26B 1/048
See application file for complete search history.

(56) References Cited

U.S. PATENT DOCUMENTS 4,719,700 A * 1/1988 Taylor, Jr. ..... B26B 1/048 30/158
5,325,588 A * 7/1994 Rogers ..... B25G 1/06 30/155
5,915,792 A * 6/1999 Sakurai ..... B26B 1/048 30/161
D426,446 S 6/2000 Chau
D426,447 S 6/2000 Chau
D492,179 S 6/2004 Hernandez et al.
6,826,836 B1 * 12/2004 Lin ..... B26B 1/048 30/155
7,313,866 B2 1/2008 Linn et al.
7,322,110 B2 1/2008 Hernandez et al.
D568,137 S 5/2008 Hernandez, Jr.
7,891,098 B2 2/2011 Parker et al.
8,413,338 B2 4/2013 Freeman
8,499,460 B1 8/2013 Pearman
9,427,878 B2 8/2016 Hernandez
10,035,272 B2 7/2018 Bruhns
2018/0169874 A1 * 6/2018 Halucha ..... B26B 1/042

* cited by examiner

*Primary Examiner* — Stephen Choi
(74) *Attorney, Agent, or Firm* — Fulwider Patton LLP

(57) ABSTRACT

A folding knife has a blade pivotably mounted between a first handle scale and a second handle scale and attached to a first pivot post and a second pivot post. A locking mechanism is slidably mounted in the first handle scale and is spring biased into contact with the first pivot post. The locking mechanism is spring biased into contact with a first groove on the first pivot post when the blade is in a closed position thereby preventing the blade from pivoting to the open position, and the locking mechanism is spring biased into contact with a second groove on the first pivot post when the blade is in an open position thereby preventing the blade from pivoting to the closed position.

10 Claims, 5 Drawing Sheets

FIG. 2
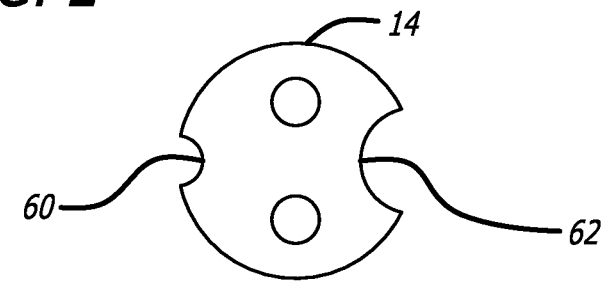
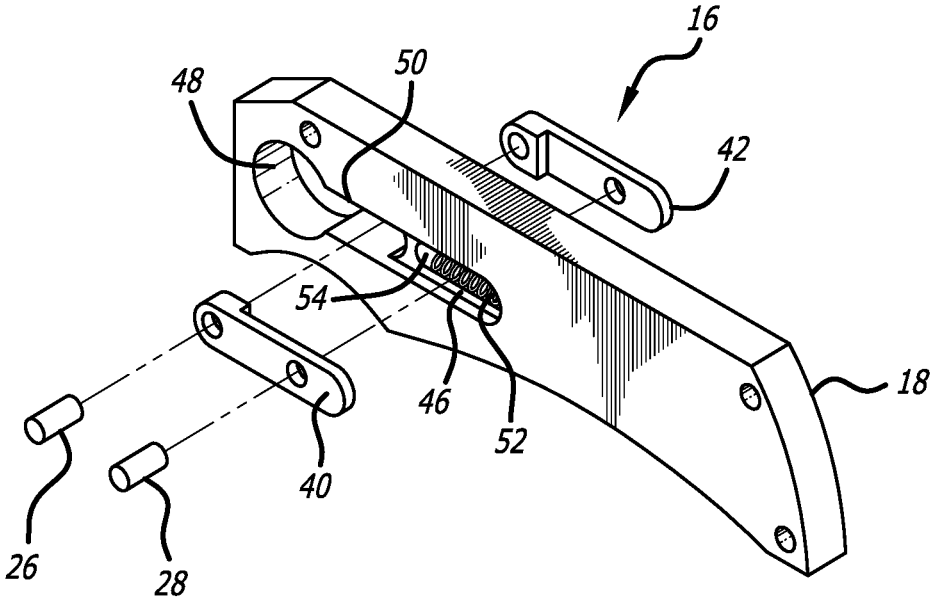
FIG. 3A

FOLDING KNIFE

BACKGROUND

The present invention relates to folding knives. Specifically, the invention relates to providing a sliding locking bar for safely and easily locking the blade of a folding knife in an open and closed position.

Spring assisted folding knives are known in the art. Typically, a folding knife comprises a handle with a hollow section between two side walls of a handle. An pin, or axle, is provided at one end of the handle, about which a blade is configured to pivotingly rotate. The blade has a closed position in which the blade is rotated about the pin to reside between the two side walls of the handle. In this position, the knife is safe to handle and to store. The blade has an open position, in which the blade is rotated about the pin to extend away from the handle. In this position, the knife is ready for use, which may include cutting, piercing, slicing etc. In some knives, a spring is included to provide a biasing force for urging the blade open when the blade is in a closed position, and for urging the blade closed when the blade is not in a closed position. In some knives, a spring may take the form of a leaf spring, in which a cantilevered tip of the leaf spring biases a cam shaped surface on the blade, thereby providing a bias to prevent the blade from opening when it is closed, and to prevent the blade from closing when it is open. In other knives, a spring may take the form of a helical spring, and may be positioned to the side of the blade within the handle of the knife. However, these knives known in the art are beset by problems. Leaf springs are limited in that they cannot be configured to bias a closed blade into an open condition. Helical springs positioned to the side of the blade within the handle are prone to collect dirt that is inaccessible to the user, and which is therefore difficult to clean out. As such, the dirt may eventually prevent the spring from operating correctly.

In folding knives having a manual operation, a user opens the blade by grasping the blade or pushing a knob protruding from the blade in order to rotate the blade into the open position. Assisted-opening knives include a bias mechanism that aids the user in opening the blade, typically requiring the user to open the blade a certain amount manually, then assisting the opening of the blade the rest of the way into the open position. Automatic knives include a bias mechanism configured to fully open the blade upon actuation of an opening mechanism, such as a push-button. A folding knife may have a locking mechanism configured to lock the blade into one or both of the closed or open positions. A number of locking mechanisms are known including liner locks having a spring arm that engages the rear of the blade to lock the blade open.

Thus, there is a need in the art for a folding knife having an easy to use and safe locking mechanism for use in locking the knife blade in both the open and closed positions.

SUMMARY OF THE INVENTION

In a preferred embodiment, a folding knife includes a first handle scale and a second handle scale spaced apart and connected together to form a handle. A knife blade is pivotably mounted between the first handle scale and the second handle scale. A first pivot post is mounted in the first handle scale and a second pivot post is mounted in the second handle scale, and the blade is attached to the first pivot post and the second pivot post by attachment pins or screws. A locking mechanism is slidably mounted in the first handle scale and is spring biased into contact with the first pivot post. A first groove and a second groove are spaced diametrically apart on the first pivot post so that the locking mechanism is biased into contact with the first groove when the blade is in a closed position thereby preventing the blade from pivoting to the open position, and the locking mechanism is biased into contact with the second groove when the blade is in an open position thereby preventing the blade from pivoting to the closed position. A spring is mounted in the first handle scale and is in contact with the locking mechanism to provide a spring force to bias the locking mechanism into contact with the first pivot post. The blade includes a tab that contacts a surface on a handle spacer when the blade rotates open, thereby preventing the blade from over-rotating and further providing structural support to the locking mechanism against force applied on a cutting edge of the blade. When the blade is in the closed position, sliding the locking mechanism axially away from the first groove on the first pivot post overcomes the spring force and disengages the locking mechanism from the first pivot post so that the blade can pivot toward the open position. When the blade pivots to the open position, the spring force acting on the locking mechanism automatically pushes the locking mechanism into contact with the second groove of the first pivot post, thereby locking the blade in the open position.

BRIEF DESCRIPTION OF THE DRAWINGS

FIG. 2 is a front view of a first pivot post for use in locking the knife blade in an open position and a closed position.

FIG. 3A is an isometric view of the main handle scale and sliding locking bars.

DETAILED DESCRIPTION OF THE PREFERRED EMBODIMENTS

Figure 1:
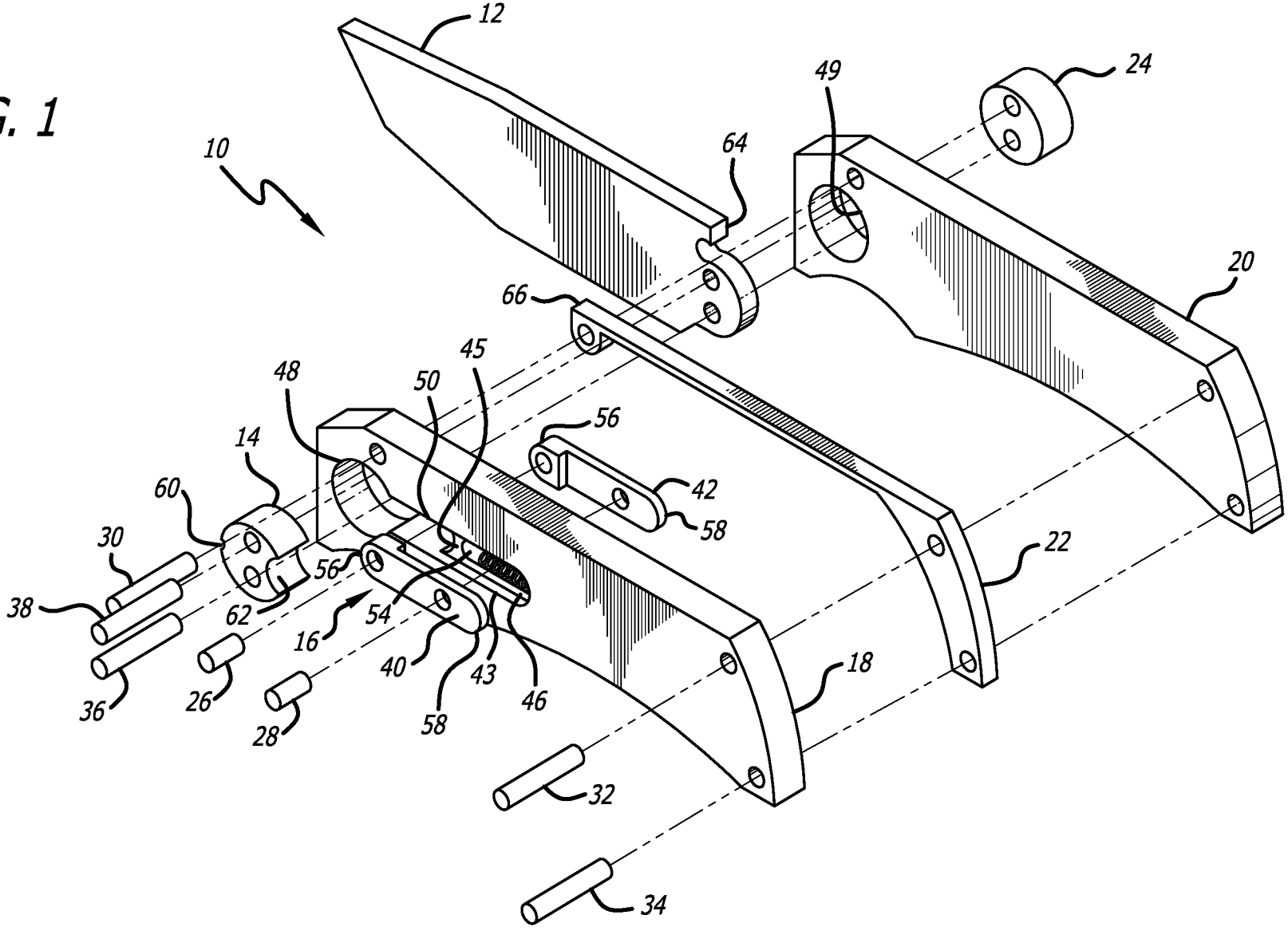
FIG. 1 is an exploded isometric view of a folding knife depicting the knife blade in an open position.
Figure 3B:
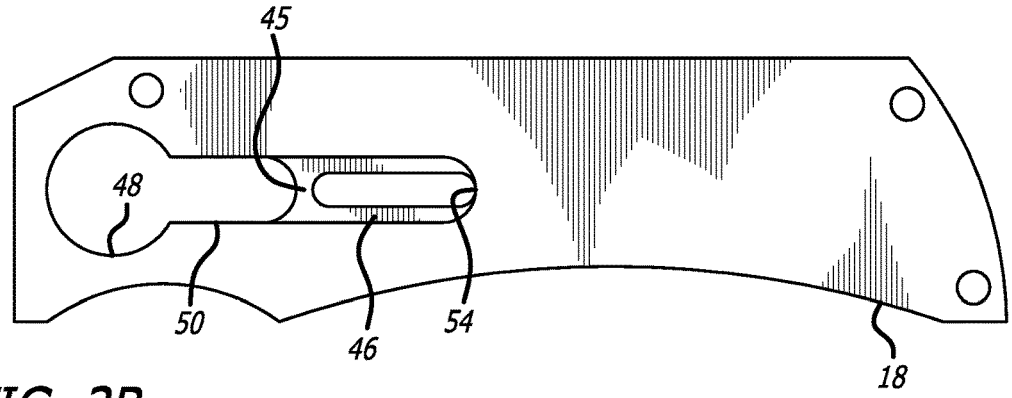
FIG. 3B is a front elevational view of the main handle scale.
Figure 3C:
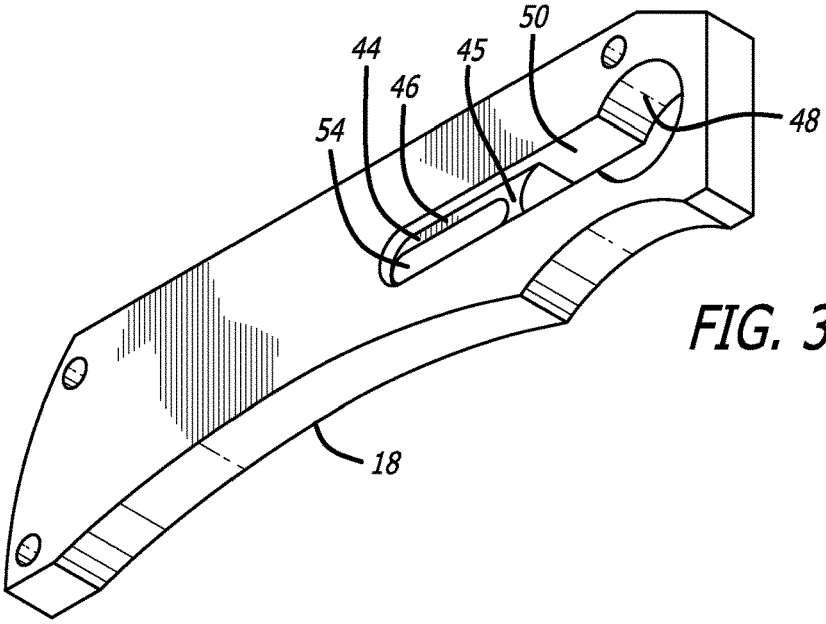
FIG. 3C is an isometric view of the main handle scale.
Figure 3D:
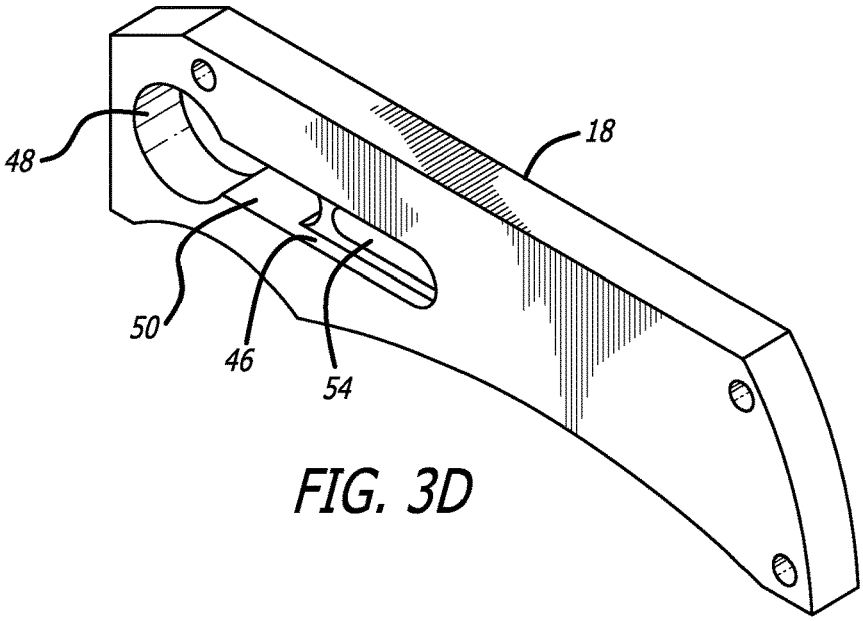
FIG. 3D is an isometric view of the main handle scale.
Figure 4A:
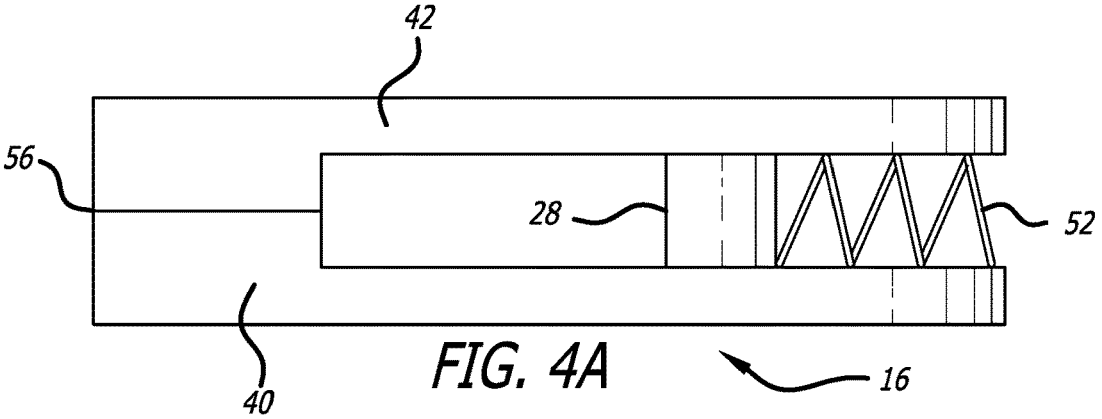
FIG. 4A is a top view of the first lock bar attached to the second lock bar with pins.
Figure 4B:
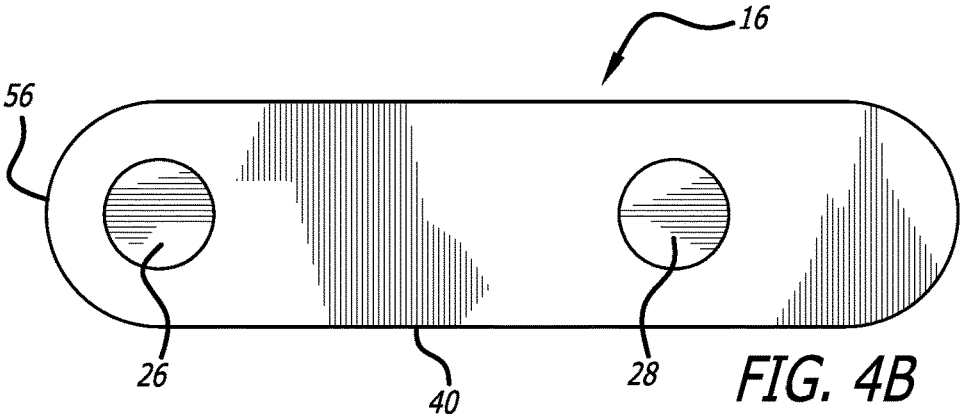
FIG. 4B is a front view of the first lock bar.
Figure 4C:
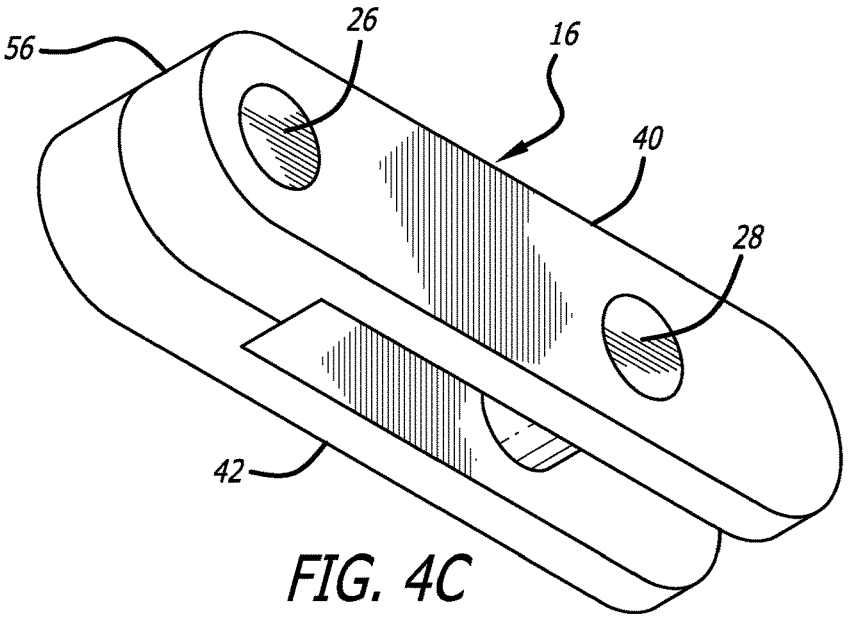
FIG. 4C is an isometric view of the first lock bar attached to the second lock bar with pins.

With reference to the figures, a folding knife is described having features of the invention. In one embodiment of the invention, as shown in FIGS. 1-6, a folding knife 10 has a blade 12 that is attached to a first pivot post 14 and a second pivot post 24. The blade 12 is sandwiched between a first handle scale 18 and a second handle scale 20, with a handle spacer 22 also sandwiched between the first handle scale 18 and the second handle scale 20. Three pins, 30, 32 and 34 are used to attach the first handle scale, the second handle scale, the handle spacer, and the blade 12 together. A reference to pins herein can include any type of known fastening device in the art such as a straight tubular pin, screws with threads, Allen Sets, and the like. The first pivot post 14 is mounted in the first handle scale 18 in a first aperture 48. Similarly, the second pivot post 24 is mounted in the second handle scale 20 in a second aperture 49. The first pivot post and the second pivot post fit snuggly in the first aperture 48 and second aperture 49 respectively, but not in interference fit. The first pivot post 14 and the second pivot post 24 must be capable of rotating in the first aperture 48 and second aperture 49 respectively in order to permit the blade 12 to pivot and rotate from the closed to the open position, and vice versa, without undue drag or interference. Two locking pins 36, 38 extend through two apertures in the first pivot post 14, two apertures in blade 12, and two apertures in the second pivot post 24 so that as the two pivot posts rotate, the blade 12 also will rotate from closed to open and vice versa.

Figure 5:
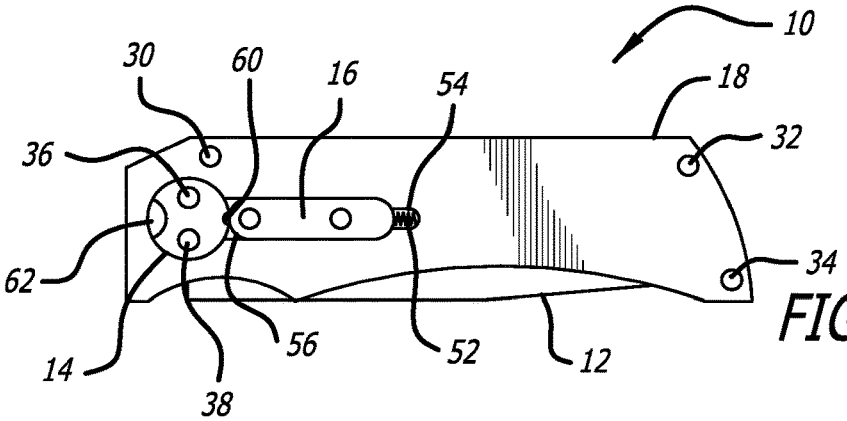
FIG. 5 is a side schematic view, partially in section, of the main handle scale and the knife blade in the closed and locked position.

In further with keeping with the invention, and referring to FIGS. 1-7, a locking mechanism 16 is comprised of first lock bar 40 and a second lock bar 42. The locking mechanism 16 is mounted in the first handle scale 18 so that the first lock bar 40 and the second lock bar 42 are flush with the outside surfaces of the first handle scale 18. A first cut out 43 and a second cut out 44 are formed in the first handle scale 18, with a mid-section 45 that is essentially a web of material between the first cut out 43 and the second cut out 44. The first lock bar 40 is positioned in the first cut out 43 and the second lock bar 42 is positioned in the second cut out 44, with the mid-section in between the first lock bar and the second lock bar. The first lock bar 40 and the second lock bar 42 are attached together with pins 26 and 28. The first lock bar and second lock bar are able to slide axially in first slot 46 which is formed by the first cut out 43 and the second cut out 44. Further, a second slot 50 extends axially from the first slot 46 and includes the first aperture 48 which receives the first pivot post 14. Thus, the locking mechanism 16, which includes the first lock bar 40 and the second lock bar 42, can slide axially back and forth along the first slot 46 and the second slot 50, and in contact with the first pivot post 14. As seen in the figures, a spring 52 is mounted in spring cavity 54 in the first handle scale 18 such that the spring is in between the first lock bar 40 and the second lock bar 42. The spring is always in compression and thereby providing a spring force on the first lock bar 40 and the second lock bar 42 by extending into and engaging pin 28 as shown in FIGS. 4A-4C. Thus, as the locking mechanism 16 slides back and forth in the first slot 46 and the second slot 50, there is constant spring force biasing the locking mechanism 16 toward the first aperture 48, and into constant contact with the first pivot post 14 when it is mounted in the first aperture 48. First lock bar 40 and second lock bar 42 have a first end 56 and a second end 58. The first end 56 is always in constant contact with the first pivot post due to the spring force of spring 52 biasing the locking mechanism 16 toward the first pivot post 14 as shown more clearly in FIGS. 5-7, the knife blade 12 is pivoted from a closed position shown in FIG. 5 to an open position in FIG. 7. In FIG. 5, the locking mechanism 16 is biased toward the first pivot post 14 and is in engagement with first groove 60 in the first pivot post 14. The first groove 60 is an arcuate section removed from the first pivot post 14 that allows the first end 56 of the first lock bar 40 to extend into the first groove 60 thereby locking the first pivot post 14, and hence the blade 12, in a closed position. When in the closed position, the first end 56 of the first lock bar 40 rests under spring tension against the first groove 60 in the pivot post 14. Given that first groove 60 is shallow and has a smaller radius than first end 56, the two structures are only partially interlocked. This results in a connection that is sufficient for resisting unintentional rotation of the blade, but upon the user manually rotating the blade (thus rotating the pivot post 14 as well), the first groove 60 is shallow enough that it forces the round first end 56 from within the first groove 60 and onto the circumferential surface of the pivot post thereby disengaging the detent (locking) system.

Figure 6:
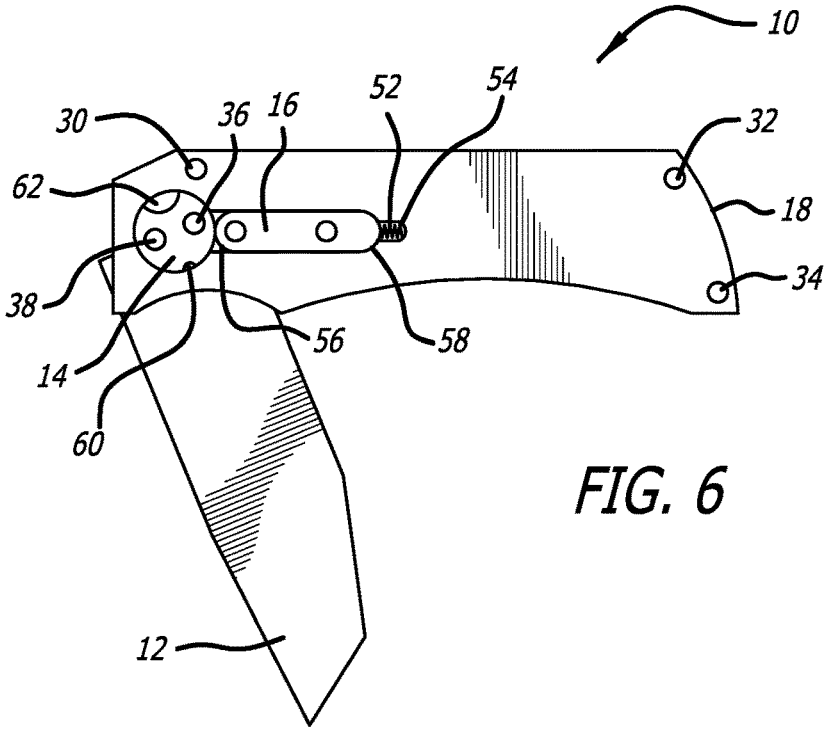
FIG. 6 is a side schematic view, partially in section, of the knife blade pivoting from a closed to an open position.
Figure 7:
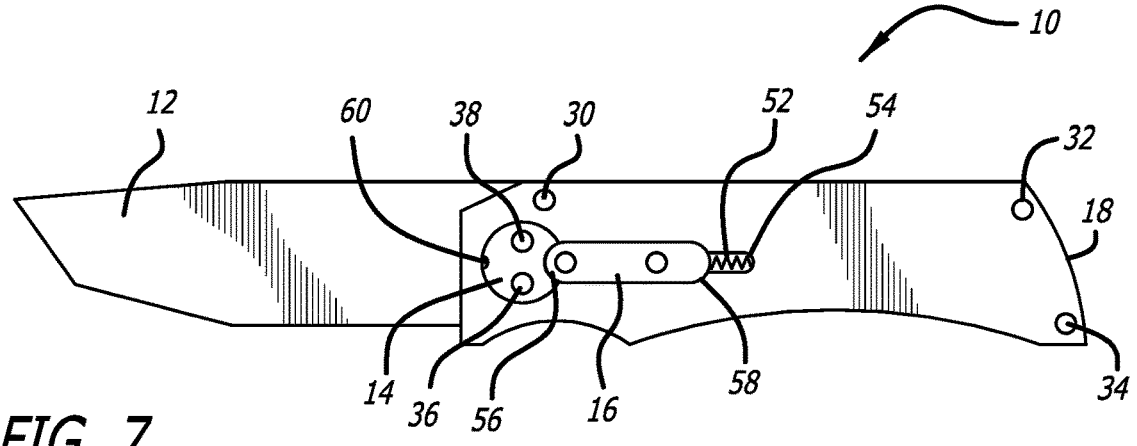
FIG. 7 is a side schematic view, partially in section, of the knife blade in an open and locked position.

In order to open the blade, the user applies thumb force through means of a conventional thumb stud or a thumb hole mounted on the blade (not shown). Thus, the locking mechanism 16 is moved away from the first pivot post 14 using thumb pressure from the user on the thumb stud (not shown) to overcome the spring force of spring 52 and slide the locking mechanism 16 in first slot 46 and second slot 50. The distance the locking mechanism 16 moves is anywhere in the range from 0.005 inch to 0.01 inch. Further, to overcome the spring force of spring 52, only a slight to modest amount of thumb pressure is required to move the locking mechanism 16 axially away from the first pivot post 14, and hence the first end 56 of lock bar 40 moves out of first groove 60 of the first pivot post 14. The user can then rotate or pivot the blade 12 as shown in FIG. 6 which also rotates first pivot post 14. The user removes the thumb pressure on the locking mechanism 16 so that the spring 52 again applies a spring force on the locking mechanism 16 to axially push the locking mechanism 16 into engagement with the first pivot post. Since the first end 56 of lock bar 40 is pushing on the outer circumference of the first pivot post 14 due to the spring force, this does not impede the opening and rotation of blade 12 toward the open position. As shown in FIG. 7, as the blade 12 pivots to the full open position, the first pivot post 14 has rotated so that the second groove 62 now aligns with and engages the first end 56 of lock bar 40. The spring force from spring 52 pushes the locking mechanism 16 axially into engagement with the first pivot post 14, and more specifically the first end 56 of lock bar 40 extends into second groove 62 in the first pivot post 14. Thus, there is now constant spring force on the locking mechanism 16 which is engaged into the second groove 62 of the first pivot post 14, thereby locking the blade 12 in the open position. The only way the blade can close from this position, is for the locking mechanism to be moved with thumb pressure axially away from the first pivot post 14 in order to remove the first end 56 of the first lock bar 40 from the second groove 62 of the first pivot post 14. As shown more clearly in FIG. 1, in order to provide additional structural support to the locking mechanism 16 when the blade 12 is in the open position, tab 64 on the blade 12 engages surface 66 on the handle spacer 22, which helps support the locking mechanism against force applied to the cutting edge of blade 12.

In order to close the blade from the open position to the closed position, the reverse of the opening sequence is provided. More specifically, the locking mechanism 16 is moved away from the first pivot post 14 using thumb pressure to overcome the spring force of spring 52, and axially move the locking mechanism 16 away from the first pivot post. In so doing, the first end 56 of the first lock bar 40 is removed from the second groove 62 of the first pivot post 14, so that the blade 12 can now be rotated by the user and pivoted back to the closed position. Again, as the blade is being rotated toward the closed position, the locking mechanism 16 is in constant contact with the first pivot post 14 by the first end 56 of the first lock bar 40 engaging the outer circumferential surface of the first pivot post 14. When the blade is pivoted to the closed position, the first groove 60 of the first pivot post 14 is aligned axially with the locking mechanism 16 so that the first end 56 of the first lock bar 40 again are engaged thereby locking the blade 12 in the closed position. It is important to remember that other than when the user is applying thumb pressure to move the locking mechanism 16 away from the first pivot post 14, there is always a spring force provided by spring 52 on the locking mechanism 16 biasing the locking mechanism 16 toward and into engagement with the first pivot post 14.

I claim:

1. A knife, comprising:

a first handle scale and a second handle scale spaced apart and connected together to form a handle;

a blade pivotably mounted between the first handle scale and the second handle scale;

a first pivot post mounted in the first handle scale and a second pivot post mounted in the second handle scale;

the blade being attached to the first pivot post and the second pivot post;

a locking mechanism slidably mounted in the first handle scale and being biased into contact with the first pivot post;

a first groove and a second groove spaced diametrically apart on the first pivot post;

wherein the locking mechanism is biased into contact with the first groove when the blade is in a closed position thereby preventing the blade from pivoting to the open position, and the locking mechanism is biased into contact with the second groove when the blade is in an open position thereby preventing the blade from pivoting to the closed position; and wherein the first handle scale has a first cutout and a second cutout configured to slidingly receive the first locking bar and the second locking bar respectively, and a midsection between the first cutout and the second cutout.

2. The knife of claim 1, wherein a spring is mounted in the first handle scale and is in contact with the locking mechanism to provide a spring force to bias the locking mechanism into contact with the first pivot post.

3. The knife of claim 2, wherein the first locking bar is attached to the second locking bar by a first pin and a second pin.

4. The knife of claim 3, wherein the first cutout and the second cutout form a first slot and a second slot for the locking mechanism to slide in.

5. The knife of claim 4, wherein the spring is in direct contact with the second pin to provide the spring force biasing the locking mechanism into contact with the first pivot post.

6. The knife of claim 5, wherein the spring is mounted in a cavity in the first handle scale.

7. The knife of claim 6, wherein the first handle scale is attached to the second handle scale and a handle spacer by a third pin, a fourth pin, and a fifth pin.

8. The knife of claim 7, wherein the first pivot post, the blade, and the second pivot post are attached together by a sixth pin and a seventh pin.

9. The knife of claim 8, wherein the blade includes a tab that contacts a surface on the handle spacer when the blade rotates open, thereby preventing the blade from over-rotating and further providing structural support to the locking mechanism against force applied on a cutting edge of the blade.

10. The knife of claim 9, wherein when the blade is in the closed position, sliding the locking mechanism axially away from the first groove on the first pivot post overcomes the spring force and disengages the locking mechanism from the first pivot post so that the blade can pivot toward the open position.

* * * * *